US007481207B2

(12) United States Patent
Evans

(10) Patent No.: US 7,481,207 B2
(45) Date of Patent: Jan. 27, 2009

(54) FUEL CONTROL SYSTEM FOR AN ENGINE

(75) Inventor: Raymond G. Evans, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 274 days.

(21) Appl. No.: 11/413,186

(22) Filed: Apr. 28, 2006

(65) Prior Publication Data

US 2007/0251493 A1 Nov. 1, 2007

(51) Int. Cl.
*F02D 41/10* (2006.01)

(52) U.S. Cl. ..... 123/682; 123/492

(58) Field of Classification Search ..... 123/682, 123/492

See application file for complete search history.

(56) References Cited

U.S. PATENT DOCUMENTS 4,924,395 A 5/1990 Evans et al.
4,950,964 A 8/1990 Evans
5,041,772 A 8/1991 Earleson et al.
5,284,119 A 2/1994 Smitley
6,024,072 A 2/2000 Hamada
6,073,592 A 6/2000 Brown et al.
6,073,610 A 6/2000 Matsumoto et al.
6,161,524 A 12/2000 Akbarian et al.
6,415,763 B1 * 7/2002 Kobayashi ..... 123/682
6,493,627 B1 12/2002 Gallagher et al.
6,497,223 B1 12/2002 Tuken et al.
6,584,392 B1 6/2003 Jankovic et al.
6,701,897 B2 3/2004 Chatfield
6,772,060 B2 8/2004 McCauley et al.
6,957,139 B2 10/2005 Bellinger

* cited by examiner

*Primary Examiner*—Erick Solis
(74) *Attorney, Agent, or Firm*—Finnegan, Henderson, Farabow, Garrett & Dunner

(57) ABSTRACT

A method of controlling an amount of fuel to an engine is disclosed. The method includes determining first and second fuel limits. The first fuel limit is indicative of a higher value than the second fuel limit. The method also includes determining an amount of fuel to be delivered to an engine as a function of at least one engine parameter. The method further includes controlling the amount of fuel to be less than or equal to the first fuel limit in a first set of operating conditions and controlling the amount of fuel to be less than or equal to the second fuel limit in a second set of operating conditions.

20 Claims, 2 Drawing Sheets

FUEL CONTROL SYSTEM FOR AN ENGINE

TECHNICAL FIELD

The present disclosure relates to fuel control system and, more particularly, to a method and apparatus for controlling fuel delivered toward an engine.

BACKGROUND

Engines, e.g., diesel or gasoline engines, typically include a fuel delivery system configured to direct fuel into one or more combustion chambers. By combusting the fuel within a variable volume chamber, e.g., a piston-cylinder arrangement, the potential energy associated with the fuel is converted into mechanical power and is typically delivered to one or more engine loads, e.g., traction loads or auxiliary loads. By increasing the amount of fuel delivered to the one or more combustion chambers, an engine can deliver increasing amounts of mechanical power to the associated loads. However, the amount of fuel that can be delivered to an engine is usually limited by one or more constraints, such as, for example, physical constraints, e.g., engine integrity, governmental constraints, e.g., emissions, and/or economical constraints, e.g., fuel efficiency. Often, an engine is operated at a percentage of its fuel limit to deliver power to steady state loads while maintaining an available margin, typically 3-5%, to deliver power to transient auxiliary loads. By restraining an engine to operate below its available power, a substantial portion of available engine power may be infrequently utilized and thus wasted.

U.S. Pat. No. 6,493,627 ("the '627 patent") issued to Gallagher et al. discloses a variable fuel limit for diesel engines. The method of the '627 patent determines a fuel limit based on ambient temperature and pressure, fuel temperature, fuel heating value, and conditions of a fuel pump and fuel injectors to account for the affects that varying operating conditions have on the volume of fuel delivered to the engine. As such, the method of the '627 patent adjusts the fuel limit as a function of operating conditions to ensure that an ultimate fuel limit, e.g., a predetermined fuel limit, is not artificially decreased when the density of the fuel decreases, e.g., with increasing temperature, or is not artificially increased when the density of fuel increases, e.g., with increasing temperature.

Although the fuel limit determined by the method of the '627 patent may be adjusted based on varying operating conditions, the method of the '627 patent maintains an ultimate fuel limit that will not be exceeded, even in transient situations, potentially leaving a portion of the available engine power under utilized. Additionally, the method of the '627 patent requires sensing operating conditions and/or predicting component wear that may decrease the accuracy of any determined variable fuel limit.

The present disclosure is directed to overcoming one or more of the shortcomings set forth above.

SUMMARY OF THE INVENTION

In one aspect, the present disclosure is directed to a method of controlling an amount of fuel delivered to an engine. The method includes determining first and second fuel limits. The first fuel limit is indicative of a higher value than the second fuel limit. The method also includes determining an amount of fuel to be delivered to an engine as a function of at least one engine parameter. The method further includes controlling the amount of fuel to be less than or equal to the first fuel limit in a first set of operating conditions and controlling the amount of fuel to be less than or equal to the second fuel limit in a second set of operating conditions.

In another aspect, the present disclosure is directed to an engine system. The engine system includes an engine including at least one combustion chamber, a fuel delivery system configured to deliver an amount of fuel toward the at least one combustion chamber, and a controller configured to determine a first fuel limit. The controller is also configured to determine the amount of fuel delivered toward the at least one combustion chamber as a function of a first value and the first fuel limit. The first value is indicative of a first order lag with respect to a previously determined amount of fuel.

In yet another aspect, the present disclosure is directed to a method of controlling a power output of an engine. The method includes determining a steady state fuel limit and a transient fuel limit greater than the steady state fuel limit. The method also includes controlling an amount of fuel delivered toward the engine to allow the engine to operate above a power output associated with the steady state fuel limit for a predetermined period of time.

DETAILED DESCRIPTION

Figure 1:
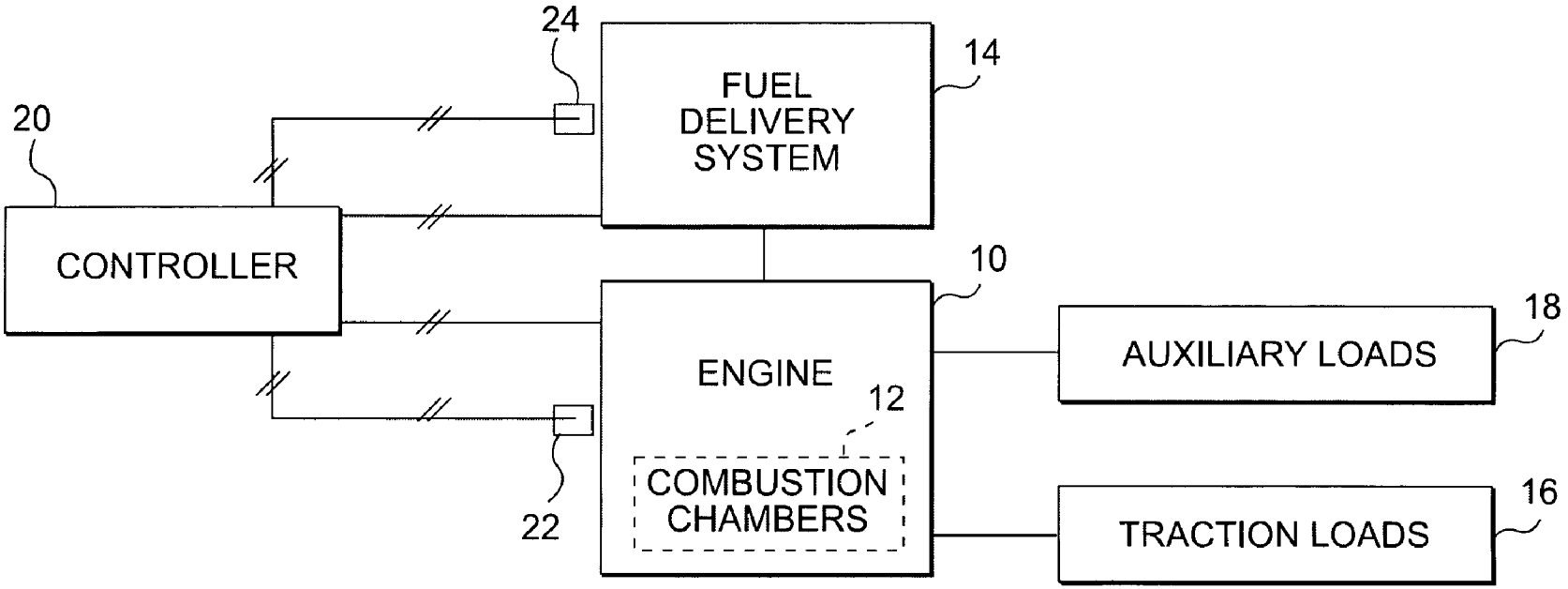
FIG. 1 is a schematic illustration of an exemplary engine in accordance with the present disclosure.

FIG. 1 illustrates an exemplary engine 10. Engine 10 may include one or more combustion chambers 12, receive fuel from a fuel delivery system 14, and may be controlled by controller 20. Engine 10 may be configured to transform potential chemical energy, e.g., fuel, into mechanical energy, e.g., torque and speed, via a combustion process within one or more of combustion chambers 12, e.g., two or four cycle piston-cylinder arrangements. The mechanical energy may be delivered toward one or more traction loads 16 and/or toward one or more auxiliary loads 18. Traction loads 16 may include, for example, loads associated with propelling a vehicle, e.g., a mobile machine, a locomotive, or a marine vessel. Auxiliary loads 18 may include, for example, loads associated with operating discretionary components, e.g., air conditioning systems, and/or non-discretionary components, e.g., coolant systems or alternators. It is contemplated that both traction and auxiliary loads 16, 18 may include transient and/or steady state operational states and may or may not cycle on and off during operation of engine 10. It is also contemplated that engine 10 may embody and/or include any conventional type of components known in the art, such as, for example, an internal combustion engine, e.g., a gasoline or diesel engine, and that fuel delivery system 14 may embody and/or include any conventional type of components known in the art, such as, for example, an electronically controlled fuel injection system or a carburetor.

Controller 20 may be configured to monitor one or more parameters of engine 10 and/or fuel delivery system 14 and control the respective operations thereof. Specifically, controller 20 may determine an amount of fuel to be delivered to one or more of combustion chambers 12 and thus the power output of engine 10. Controller 20 may include one or more microprocessors, a memory, a data storage device, a communications hub, and/or other components known in the art. It is contemplated that controller 20 may be integrated within a general control system capable of controlling additional functions of engine 10, e.g., valve timing, and/or additional systems operatively associated with engine 10, e.g., selective control of a transmission system (not shown). Controller 20 may be configured to receive input signals from one or more sensors 22, 24, perform one or more algorithms to determine appropriate output signals, and may deliver the output signals to engine 10 and/or fuel delivery system 14. It is contemplated that controller 20 may receive and deliver signals via one or more communication lines (not referenced) as is known in the art.

Sensors 22, 24 may include any conventional sensor configured to establish a signal indicative of a physical parameter, such as, for example, temperature, pressure, speed, time, or any other parameter known in the art. Specifically, sensor 22 may include one or more sensors and may be configured to establish signals indicative of parameters of engine 10 and/or combustion chamber 12. Sensor 24 may include one or more sensors and may be configured to establish signals indicative of parameters of fuel delivery system 14. For example, sensor 22 may establish signals indicative of engine speed, e.g., revolutions per minute of a crankshaft, engine temperature, e.g., coolant temperature, inlet air temperature, or exhaust temperature, air flow rates, e.g., an amount of inlet air delivered to combustion chamber 12 in a given time period, valve timing, e.g., the movement of intake and/or exhaust valves in a given time, and/or any other parameter associated with engine 10 and/or one or more of combustion chambers 12 known in the art. Additionally, sensor 24 may, for example, establish signals indicative of fuel temperature, e.g., a temperature of the fuel delivered toward engine 10, fuel flow rate, e.g., an amount of fuel delivered toward engine 10 in a given time period, and/or any other parameter associated with fuel delivery system 14 known in the art. It is contemplated that signals established by sensors 22, 24 may embody any signal, such as, for example, a pulse, a voltage level, a digital input, a magnetic field, a sound or light wave, and/or other signal format known in the art.

Figure 2:
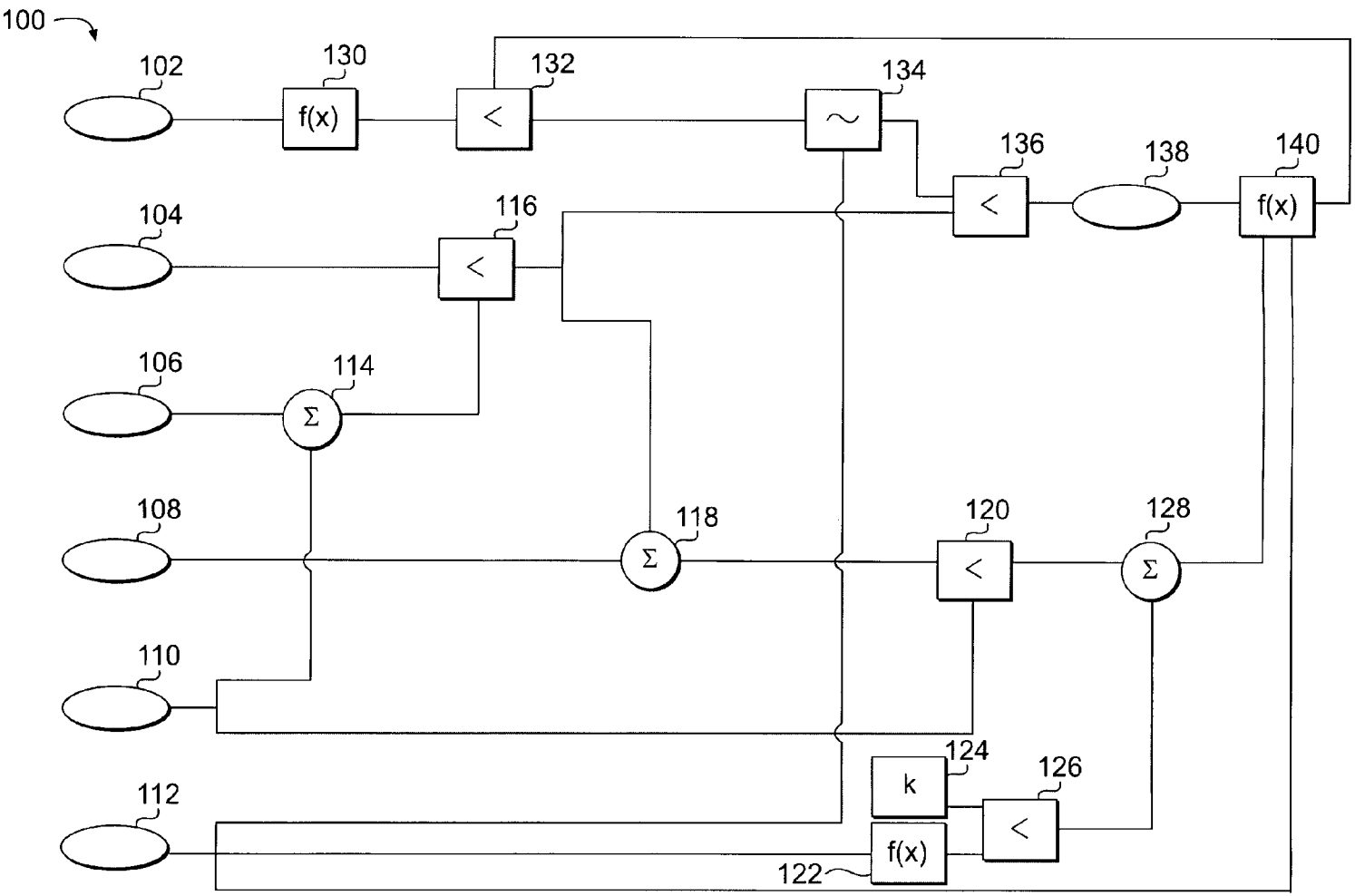
FIG. 2 is a diagrammatic illustration of an exemplary control algorithm configured to be performed by the controller of FIG. 1.

FIG. 2 illustrates an exemplary control algorithm 100. Control algorithm 100 may be performed by controller 20 to determine an amount of fuel to be delivered to one or more combustion chambers 12. Control algorithm 100 may determine an output 138 as a function of one or more predetermined inputs and/or sensed parameters of engine 10 and/or fuel delivery system 14 to affect the control and/or amount of fuel delivered from fuel delivery system 14 toward engine 10 and, correspondingly, the power output of engine 10. Control algorithm 100 may include receiving a plurality of inputs, e.g., signals generated by one or more sensors or predetermined inputs, and perform a plurality of functional relations, e.g., algorithms, equations, subroutines, look-up maps, tables, and/or comparisons to affect the amount of fuel delivered toward engine 10.

Specifically, control algorithm 100 may be configured to determine a first, e.g., a transient, fuel limit and a second, e.g., a steady state, fuel limit. Control algorithm 100 may include functionally relating a plurality of inputs to determine the transient and a steady state fuel limits. The transient and steady state fuel limits may be functionally related with one another and/or additional inputs within a feedback subroutine to control the amount of fuel to be delivered to one or more of combustion chambers 12.

Referring to FIG. 2, inputs 102, 112 may include signals indicative of a throttle operation and an engine speed, respectively, e.g., signals from sensor 22. Inputs 104, 106, 108, 110, may be include signals indicative of a predetermined transient fuel limit, a predetermined operating transient margin, a predetermined minimum transient margin, and a predetermined steady state fuel limit, respectively. Specifically, input 104 may include a value indicative of an absolute relatively short term fuel amount, e.g., a first transient fuel limit, that is undesirable to exceed because of operating conditions and input 106 may include a value indicative of a desired increase over a steady state fuel limit, e.g., an allowable transient fuel amount. Input 108 may include a value indicative of a desired decrease from a transient fuel limit, e.g., an allowable steady state fuel amount, and input 110 may include a value indicative of a relatively long term fuel amount that is undesirable to exceed because of operating conditions.

For example, input 102 may be determined from sensor 22 sensing a intake air flow rate for engine 10 or, alternatively, may be determined by sensing a position of a throttle controller, e.g., a position of a pedal or lever. Also for example, inputs 104, 106, 108 may be determined as a function of a rated fuel limit for engine 10, e.g., as a function of empirically determined values with respect to desired margins associated with short term and long term fuel amounts. Additionally for example, input 110 may be determined as a function of one or more engine parameters, e.g., engine temperature, ambient temperature, air flow rate, exhaust flow rate, combustion efficiency, and/or any other parameter known in the art to determine a steady state fuel limit for the operating conditions of engine 10. It is also contemplated that inputs 104, 106, 108 may or may not include variable inputs, such as, for example, a constant value input for the transient fuel limit and the predetermined operating transient margin or a variable value input for the steady state fuel limit determined as a function of one or more parameters of engine 10 and/or fuel delivery system 14, e.g., signals from sensors 22, 24.

Functional relation 114 may be configured to combine the predetermined steady state fuel limit and the predetermined transient margin to establish a second transient fuel limit. Specifically, functional relation 114 may functionally add the value determined from input 106 with the value determined from input 110. It is contemplated that functional relation 114 may establish a relatively short term fuel limit as a function of a steady state fuel limit and a marginal increase thereon.

Functional relation 116 may be configured to compare the first and second transient fuel limits, e.g., the fuel limits as determined from input 104 and within functional relation 114, respectively, and determine a final transient fuel limit. For example, functional relation 116 may functionally relate the first transient fuel limit and the second transient fuel limit to determine if the first transient fuel limit is less than the second transient fuel limit. Alternatively, functional relation 116 may functionally determine if the second transient fuel limit is less than the first transient fuel limit. As such, functional relation 116 may establish the final transient fuel limit as the lesser of the first and second transient fuel limits. The final transient fuel limit may be further functionally related within functional relations 118 and 136.

Functional relation 118 may be configured to combine the final transient fuel limit and the minimum transient margin, e.g., as determined from input 108, to determine a maximum steady state fuel limit. Specifically, functional relation 118 may subtract the minimum transient margin from the final transient fuel limit to establish the maximum steady state fuel limit. It is contemplated that functional relation 118 may establish a relatively long term fuel limit as a function of a transient fuel limit and a marginal decrease thereon.

Functional relation 120 may be configured to compare the maximum steady state fuel limit and the predetermined steady state fuel limit, e.g., as determined from input 108, and determine a first steady state fuel limit. For example, functional relation 120 may functionally relate the maximum steady state fuel limit and the predetermined steady state fuel limit to determine if the maximum steady state fuel limit is less than the predetermined steady state fuel limit. Alternatively, functional relation 120 may functionally determine if the predetermined steady state fuel limit is less than the maximum steady state fuel limit. As such, functional relation 120 may establish the first steady state fuel limit as the lesser of the maximum and predetermined steady state fuel limits. The first steady state fuel limit may be further functionally related within functional relation 128.

Functional relation 122 may be configured to determine an acceleration gain fuel amount as a function of engine speed, e.g., input 112. Specifically, functional relation 122 may determine an acceleration rate as a function of sensed engine speeds over a given time period. The acceleration rate may be functionally related to predetermined fuel amounts, e.g., within one or more look-up tables and/or multi-dimensional maps to determine an amount of fuel corresponding to a torque required to overcome engine and other component inertia during acceleration thereof. As such, functional relation 122 may maintain engine speed instead of diverting engine torque during acceleration. It is contemplated that the predetermined fuel amounts may be correlated to a particular type of engine and may be a function of one or more parameters, such as, for example, physical parameters, e.g., size and weight of rotating components, or efficiency parameters, e.g., combustion performance or fuel efficiency.

Functional relation 126 may be configured to functionally compare the acceleration gain fuel amount with a minimum acceleration fuel rate, e.g., constant 124, and determine a final acceleration gain fuel amount. Constant 124 may be configured as a minimum desired acceleration gain fuel amount, e.g., zero or any other minimum fuel amount, as desired. Specifically, functional relation 126 may functionally relate the acceleration gain fuel rate and the minimum acceleration fuel rate to determine if the acceleration gain fuel rate is greater than the minimum acceleration fuel rate. Alternatively, functional relation 126 may functionally determine if the minimum acceleration fuel rate is greater than the acceleration gain fuel amount. As such, functional relation 126 may determine the greater one of the minimum acceleration fuel rate and the acceleration gain fuel amount. It is contemplated that functional relation 126 may account for inertia effects associated with transitioning engine 10 from one speed to another and/or starting auxiliary components. It is also contemplated that if constant 124 is indicative of a zero acceleration fuel amount, functional relation 126 may be configured to establish a positive acceleration fuel amount to compensate for increasing engine speeds and configured to establish a zero acceleration fuel amount for decreasing engine speeds.

Functional relation 128 may be configured to combine the final acceleration gain fuel amount and the first steady state fuel amount, e.g., as determined from functional relation 120, to determine a final steady state fuel limit. Specifically, functional relation 128 may add the first steady state fuel amount and the final acceleration gain fuel amount to establish the final steady state fuel limit. The final steady state fuel limit may be further related within functional relation 140.

Control algorithm 100 may functionally relate the final transient and steady state fuel limits, e.g., as respectively determined within functional relations 116, 128 with a feedback characteristic to reduce overfueling of engine 10. Specifically, control algorithm 100 may limit a desired throttle speed with respect to the final steady state fuel limit speed determined as a function of a time lag. Additionally, control algorithm 100 may limit a desired throttle speed with respect to the final transient fuel limit during the time lag. It is contemplated that during the time lag, control algorithm 100 may, via the feedback characteristic, allow a fuel amount delivered toward engine 10 to temporarily exceed the final steady state fuel limit.

Referring again to FIG. 2, functional relation 130 may be configured to determine a desired throttle speed as a function of a throttle operation, e.g., a signal from input 102. Specifically, functional relation 130 may functionally relate throttle inputs and engine speeds via one or more relational look-up tables or multi-dimensional maps. For example, functional relation 130 may include an empirically determined look-up table relating one or more signals indicative of throttle operations with corresponding desired throttle speeds and establish a signal indicative thereof.

Functional relation 132 may be configured to compare the throttle speed and a fuel limit desired speed, e.g., as determined within functional relation 140, and determine a final desired speed. For example, functional relation 132 may functionally relate the throttle desired speed and the fuel limit desired speed to determine if the throttle desired speed is less than the fuel limit desired speed. Alternatively, functional relation 132 may functionally determine if the fuel limit desired speed is less than the throttle desired speed. As such, functional relation 132 may establish the final desired speed as the lesser of the throttle desired speed and the fuel limit desired speed. It is contemplated that during the first sequence of control algorithm 100 or if engine 10 has not received fuel from fuel delivery system 14 for a given period of time, e.g., engine 10 has been shut off, the fuel limit desired speed may be referenced to a constant value, e.g., zero or other suitable value.

Functional relation 134 may be configured to compare the final desired speed with the engine speed, e.g., as determined from input 112, and determine a desired fuel amount. Specifically, functional relation 134 may compare the final desired speed and a sensed engine speed to determine if the engine is providing, e.g., outputting, the desired speed. For example, changing conditions with respect to traction or auxiliary loads 16, 18 (referring to FIG. 1) may reduce the speed output of engine 10 due to the variable speed-torque ratio of an engine as is known in the art. It is contemplated that functional relation 134 may embody any conventional governor configured to adjust a fuel amount to establish a desired engine speed as a function of the actual engine speed. It is also contemplated that functional relation 134 may include one or more equations to compare the final desired speed and the engine speed and determine a final output speed and may additionally include one or more look-up tables to relate the final output speed with one or more fuel amounts.

Functional relation 136 may be configured to compare the desired fuel amount and the final transient fuel limit, e.g., as determined from functional relation 116, and determine an amount of fuel, e.g., output 138, to be delivered to engine 10. For example, functional relation 136 may functionally relate the desired fuel amount and the final transient fuel limit to determine if the desired fuel amount is less than the final transient fuel limit. Alternatively, functional relation 136 may functionally determine if the final transient fuel limit is less than the desired fuel amount. As such, functional relation 136 may establish the amount of fuel to be delivered to engine 10 as the lesser of the desired fuel amount and the final transient fuel limit.

Output 138 may be configured as a flag criteria and, as such, control algorithm 100 may be configured to be integrated within a fuel delivery control algorithm capable of controlling one or more components, e.g., fuel injectors, within fuel delivery system 14 and/or output 138 may affect the control of such components via another algorithm. It is contemplated that output 138 may be configured as a control signal and, as such, control algorithm 100 may be configured to directly control one or more components, e.g., fuel injectors, within fuel delivery system 14 and/or configured in any suitable manner known in the art. It is also contemplated that output 138 may be configured in terms of volume, mass, injector timings, and/or any other suitable term known in the art.

Functional relation 140 may be configured to determine the fuel limit desired speed as a function of the final steady state fuel limit, e.g., as determined within functional relation 128, the final fuel amount, e.g., output 138, and engine speed, e.g., input 112. Specifically, functional relation 140 may include a time lag computation to retard any overfueling correction within a feedback characteristic of control algorithm 100. For example, functional relation 140 may determine a suitable time lag, e.g., a first order time lag, with respect to the final fuel amount to retard a feedback correction of the final fuel limit, e.g., output 138, with respect to the final steady state fuel limit. As such, the first order lag may allow the final fuel value to temporarily exceed the final steady state fuel limit.

Additionally, functional relation 140 may functionally relate the time lagged final fuel amount, e.g., a value less than the final fuel amount, the engine speed and the final steady state fuel limit to determine a fuel limit desired speed. For example, functional relation 140 may multiply the engine speed and a ratio of the final steady state fuel amount and the time order lagged final fuel amount to establish the fuel limit desired speed. As such, if the final fuel amount is less than the final steady state fuel limit, the feedback characteristic of control algorithm 100 will have substantially no effect upon the determination of the final fuel value. Conversely, if the final fuel amount is greater than the final steady state fuel limit, the feedback characteristic of control algorithm 100 may, as a function of the time lag, override the throttle desired speed and control the engine to the fuel limit desired speed and reduce undesirable overfueling of engine 10. It is contemplated that the time lag may be any suitable time lag and may or may not be algorithmic.

It is contemplated that the functional relations of control algorithm 100 may be performed in any order and are described herein with a particular order for exemplary purposes only. It is also contemplated that control algorithms 100 may be performed continuously, periodically, with or without a uniform frequency, and/or singularly. It is also contemplated that any comparison within control algorithm 100, e.g., functional relations 116, 120, 132, 130 may, if the two inputs thereto are substantially and/or statistically equal, determine an output thereof as either of the two inputs. For example any of functional relations 116, 120, 132, 130 may embody any low wins logic algorithm known in the art. It is further contemplated that any functional relation within control algorithm 100 may include any look-up table, multi-dimensional map, equation, formula, subroutine, algorithm, any other functional relation known in the art, and/or combination thereof populated and/or functionally determined via any suitable method, e.g., empirically determined or determined from test data.

INDUSTRIAL APPLICABILITY

The disclosed fuel control system for an engine may be applicable for any combustion engine. The disclosed system may allow an engine to operate substantially close to an available, e.g., a rated, power by permitting the engine to operate beyond the rated power during transient periods. The operation of engine 10 and, in particular, control algorithm 100 will be explained below with reference to a engine 10 being associated with a locomotive, however, it is understood that engine 10 may be associated with any machine.

Referring to FIG. 1, engine 10 may be associated with a locomotive and configured to provide power to one or more traction devices, e.g., wheels configured to engage a track and propel the locomotive at a ground speed, and one or more auxiliary components, e.g., cooling fans, electric power generators, and/or other components known in the art. Engine 10 may be operatively connected with traction and/or auxiliary loads 16, 18 via any suitable transmission (not shown) such as, for example, a continuously variable transmission, as is conventional in a locomotive, or a step-change transmission. As such, traction loads 16 may include loads transferred to engine 10 from traction devices experiencing changing conditions, e.g., changing grades, accelerations, or decelerations, and auxiliary loads 18 may include operation of cycling auxiliary components, e.g., one or more auxiliary components becoming operational or changing groups of components requiring power. Engine 10 may, in response to variable traction and/or auxiliary loads 16, 18, be configured to output variable power as a function of variable amounts of fuel delivered toward engine 10.

Engine 10 may include one or more operating conditions, such as, for example, engine temperature, fuel economy, combustion efficiency, torque and/or speed limits, and/or any other condition known in the art, which may be undesirable to exceed. As such, the amount of fuel delivered toward engine 10 from fuel delivery system 14 may be controlled to avoid and/or reduce the occurrence of engine 10 exceeding such a condition. Fuel delivery system 14 may, for example, deliver fuel, e.g., diesel fuel or gasoline, toward engine 10 and, in particular, toward one or more combustion chambers 12 via fuel injectors to affect a power stroke of a piston-cylinder arrangement of a combustion engine as is known in the art. It is noted that engine 10 may output power, e.g., torque and speed, in a substantially increasing relation to the amount of fuel delivered to engine 10. Controller 20 may be configured to monitor one or more parameters of engine 10 and/or fuel delivery system 14 to determine an amount of fuel to be delivered toward engine 10. Specifically, controller 20 may perform control algorithm 100 to determine a final fuel amount and may control the operation of fuel delivery system 14 to substantially deliver the determined amount of fuel toward engine 10.

Referring to FIG. 2, control algorithm 100 may determine and control a final fuel amount as a function of first and second, e.g., the final transient and steady state, fuel limits. Specifically, control algorithm 100 may determine the final transient fuel limit as a function of an absolute short term fuel limit, e.g., input 104, and a normal transient margin relative to a long term fuel limit, e.g., input 106, and a predetermined steady state fuel limit, e.g., input 110. Additionally, control algorithm 100 may determine the final steady state fuel limit as a function of the predetermined steady state fuel limit, e.g., input 110, an engine speed, e.g., input 112, a final acceleration gain fuel amount, e.g., as determined within functional relation 126, a minimum transient fuel limit margin, e.g., input 108, and the final transient fuel limit. Furthermore, control algorithm 100 may determine the final fuel amount, e.g., output 138, as a function of a desired engine speed, e.g., input 102, and the final transient and steady state fuel limits.

Control algorithm 100 may determine a throttle desired engine speed from a throttle input, e.g., input 102, functionally relate the throttle desired engine speed with a fuel limit desired speed, and functionally relate the lesser thereof, via a governor, to determine the final fuel amount. The final fuel amount may be limited via the feedback characteristic to prohibit the final fuel amount from exceeding the final transient fuel limit over relatively short periods of time and from exceeding the final steady state fuel limit over relatively long periods of time. Specifically, control algorithm 100 may functionally relate a time lagged final fuel amount within functional relation 140 to determine the fuel limit desired speed, e.g., the engine speed related to the steady state fuel limit.

Specifically, control algorithm 100, via functional relation 140, may be configured to limit the final fuel amount to be equal to or less than the final steady state fuel limit for relatively long term time periods while allowing functional relations 134, 136 to limit the final fuel amount to be equal to or less than the final transient fuel amount for relatively short term time periods. It is noted that the operational description of functional relation 140 and the feedback characteristic of control algorithm 100 below are made with reference to specific amounts of fuel, time, speeds, and ambient conditions for exemplary purposes only and the feedback loop and control algorithm 100 are applicable to any engine, any operating conditions, and any ambient conditions.

For example, control algorithm 100 may determine a final fuel amount to be indicative of 8 cc for a given sequence of control algorithm 100, and for given operating conditions and type of engine 10, to achieve an engine speed of 1200 rpm at a given throttle operation. Assuming that the final steady state fuel limit, e.g., the output of functional relation 128, is 10 cc and that functional relation 140 includes a first order lag, functional relation 140 may establish a ratio of the final steady state fuel limit to the time lagged final fuel amount to be greater than one, e.g., less than or equal to 10/8. As such, functional relation 140 may functionally relate, e.g., multiply, the ratio with the engine speed of 1200 rpm, e.g., input 112, to establish a fuel limit desired speed to be greater than the engine speed, e.g., 1200×10/8. Functional relation 132 may compare the fuel limit desired speed and throttle desired speed and may communicate the throttle desired speed, e.g., the lower speed, toward functional relation 134. Functional relation 134 may compare the throttle desired speed and the engine speed and, assuming substantially constant engine loading, control algorithm 100 may establish the final fuel amount to be an amount required to maintain engine speed, e.g., 8 cc.

During increasing engine loading, e.g., during acceleration or increasing traction or auxiliary loads 16, 18, the final amount of fuel determined within functional relation 134, configured to maintain the desired throttle speed of 1200 rpm and the increasing engine loading, may increase. As such, the time lagged final fuel amount may be determined, at a given sequence of control algorithm 100, to be greater than 10 cc, e.g., 11 cc. Functional relation 140 may determine the ratio of steady state fuel limit to final fuel amount to be less than one, e.g., 10/11, and may determine the fuel limit desired speed to be less than the engine speed, e.g., 1200 rpm×10/11. Functional relation 132 may then output the fuel limit desired speed to functional relation 134 which may compare the fuel limit desired speed and the engine speed and, because the fuel limit desired speed may be less than the engine speed, control algorithm 100 may establish the final fuel amount to be less than 11 cc and thus reduce the power output of engine 10.

The time lagged final fuel amount allows the final fuel amount to temporarily exceed the steady state fuel limit, if necessary. Functional relation 136 controls the final fuel amount to be less than the transient fuel limit, e.g., as determined within functional relation 116, regardless of the time lag allowing the final fuel amount to temporarily exceed the steady state fuel limit. It is contemplated that the final fuel amount may exceed the steady state fuel limit for a given amount of time as a function of the degree of the time lag. Control algorithm 100 enables, by allowing the final fuel amount to temporarily exceed the steady state fuel amount, engine 10 to supply power both to achieve desired throttle speed and increasing loads, i.e., enables engine 10 to supply power to increasing loads while maintaining engine speed as compared to lowering engine speed to power increasing loads if only limited by the final steady state fuel limit.

As control algorithm 100 limits the final fuel amount to be lower than that otherwise demanded by a throttle desired speed, the increasing loads may be reduced, e.g., acceleration may no longer be necessary because a new speed has been achieved or one or more auxiliary components have achieved steady state operating conditions or have cycled off. As such, control algorithm 100 may increase the final fuel amount within functional relation 134. For example, assuming the increasing load was due to acceleration affected by an increased desired throttle speed, engine speed may increase because both the throttle desired speed and the fuel limit desired speed are greater, e.g., throttle desired speed may be greater because of an increased throttle operation and engine speed may be greater because functional relation 140 may determine a fuel limit desired speed greater than the engine speed, e.g., as determined from input 112. As engine speed increases, it may over time achieve the desired throttle speed, at which sequence, functional relation 132 may output the desired throttle speed which may lower the final fuel amount by establishing a lower load on engine 10, e.g., reducing or eliminating acceleration. As such, engine 10 and control algorithm 100 may achieve a new operating condition whereby the final fuel amount may again be less than the steady state fuel limit. It is noted that variable traction and auxiliary loads 16, 18 may be such that the amount of fuel determined to be necessary to supply sufficient power to all engine loads is less than or equal to the final steady state fuel limit. As such, control algorithm 100 may not determine a final fuel amount that exceeds neither the final steady state fuel limit nor the final transient fuel limit and the feedback characteristic of control algorithm 100 may have substantially no affect on the final fuel amount.

Because control algorithm 100 allows a final fuel amount to temporarily exceed a steady state fuel limit, it may supply power to both a constant load, e.g., a constant traction speed, and an increasing load, e.g., an increasing auxiliary load, without reducing engine speed. As such, control algorithm 100 may allow engine 10 to absorb transient loads, e.g., inertia loads, which may reduce to a steady state loading before exceeding the time delay associated with the first order lag. For example, if engine 10 is operating close to the steady state fuel limit and an auxiliary component cycles on which requires a transient fuel amount to exceed the steady state fuel limit because of inertial resistance, but requires a steady state fuel amount that does not exceed the steady state fuel amount, control algorithm 100 allows for continuous power to traction loads by temporarily exceeding the steady state limit. Additionally, control algorithm 100 may allow engine 10 to operate closer to its rated power output, e.g., the steady state fuel limit may be higher than conventional limits, because relatively short term load increases may be absorbed by temporarily allowing engine 10 to exceed its rated power output thus reducing the amount of reserved power margin and gaining steady state operating power.

It will be apparent to those skilled in the art that various modifications and variations can be made to the disclosed fuel control system for an engine. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A method for controlling fuel delivered to an engine comprising:

determining first and second fuel limits as a function of an engine speed and at least one additional engine parameter, the first fuel limit indicative of a higher value than the second fuel limit;

determining an amount of fuel to be delivered to an engine as a function of at least the engine speed; and controlling the amount of fuel to be less than or equal to the first fuel limit in a first set of operating conditions and controlling the amount of fuel to be less than or equal to the second fuel limit in a second set of operating conditions.

2. The method of claim 1, wherein the first fuel limit is indicative of a fuel limit for transient engine loads and the second fuel limit is indicative of a fuel limit for steady state engine loads.

3. The method of claim 1, wherein the first set of operating conditions includes an engine loading requiring an amount of fuel greater than the second fuel amount, the method further comprising:

operating within the first set of operating conditions for a predetermined period of time; and transitioning from the first set of operating conditions to the second set of operating conditions after expiration of the predetermined amount of time.

4. The method of claim 1, wherein determining an amount of fuel to be delivered to an engine includes:

determining a first amount of fuel as a function of a first speed;

comparing the first amount of fuel and the first fuel limit and determining a fuel value as the lesser one of the first amount of fuel and the first fuel limit;

determining a second speed as a function of the first fuel value, the second fuel limit and the engine speed;

determining a third speed as S function of a throttle position; and comparing the second speed and the third speed and determining the first speed to be substantially equal to the lesser one of the second and third speeds.

5. The method of claim 4, wherein:

the second speed is indicative of a desired speed with respect to a steady state fuel limit; and the third speed Is Indicative of a desired speed with respect to a throttle operation.

6. The method of claim 4, wherein determining the second speed includes applying a first order lag with respect to the first fuel value.

7. An engine system comprising:

an engine including at least one combustion chamber;

a fuel delivery system configured to deliver an amount of fuel toward the at least one combustion chamber; and a controller configured to:

determine a first fuel limit; and determine the amount of fuel delivered toward the at least one combustion chamber as a function of a first value, the first value being indicative of a first order lag with respect to a previously determined amount of fuel delivered toward the at least one combustion chamber, and the first fuel limit.

8. The engine system of claim 7, wherein the controller is further configured to:

determine a second fuel limit; and control the amount of fuel delivered toward the at least one combustion chamber to be less than or equal to the second fuel limit during a period of time associated with the first order lag.

9. The engine system of claim 8, wherein the first fuel limit is indicative of a steady state limit and the second fuel limit is indicative of a transient fuel limit, the second fuel limit being greater than the first fuel limit.

10. The engine system of claim 7, wherein determining the amount of fuel delivered toward the at least one combustion chamber further includes:

determining a first speed indicative of a speed associated with a throttle operation;

determining a second speed as a function of an engine speed and a first ratio functionally relating the first value with respect to the first fuel limit;

comparing the first speed and the second speed to determine if the first speed is less than the second speed; and determining the amount of fuel delivered toward the at least one combustion chamber as a function of the first speed if the first speed is less than the second speed.

11. The engine system of claim 10, further including determining the amount of fuel delivered toward the at least one combustion chamber to be less than or equal to the second speed if the first speed is not less than the second speed.

12. The engine system of claim 7, wherein the controller is configured to determine the first fuel limit as a function of:

a first steady state fuel limit determined as a function of at least one operating parameter of the engine;

a second steady state fuel limit determined as a function of a first transient fuel limit and a first predetermined value; and a an acceleration fuel limit determined as a function of an engine speed and at least one predetermined value.

13. The engine system of claim 12, wherein the transient fuel limit is determined as a function of:

a second transient fuel limit determined as a function of at least one operating parameter of the engine; and a third transient fuel limit determined as a function of the first steady state fuel limit and a second predetermined value.

14. The engine system of claim 12, wherein the first steady state fuel limit and the second transient fuel limit are variable as a function of changing engine operating conditions.

15. A method of controlling a power output of an engine comprising:

determining a steady state fuel limit as a function of an engine speed and at least a first additional engine operating parameter;

determining a transient fuel limit as a function of the engine speed and at least a second additional engine operating parameter, the transient fuel limit being greater than the steady state fuel limit; and controlling an amount of fuel delivered toward the engine to allow the engine to operate above a power output associated with the steady state fuel limit for a predetermined period of time.

16. The method of claim 15, further including subsequently controlling the amount of fuel delivered toward the engine to be less than or equal to the steady state fuel limit after expiration of the period of time.

17. The method of claim 15, further including controlling the amount of fuel delivered toward the engine to control the engine to operate at or below a power output associated with the transient fuel limit during the predetermined period of time.

18. The method of claim 15, further including:

determining a first speed as a function of a throttle signal;

determining a second speed as a function of the amount of fuel delivered toward the engine, a first order lag function, the steady state fuel limit, and the engine speed;

comparing the first and second speeds and determining the lesser one thereof; and determining the amount of fuel delivered toward the engine as a function of the lesser one of the first and second speeds.

19. The method of claim 18, wherein determining the amount of fuel delivered toward the engine includes:

determining a first fuel amount as a function of the lesser one of the first and second speeds;

comparing the first fuel amount with the transient fuel limit and determining the lesser one thereof; and establishing the amount of fuel delivered toward the engine as the lesser one of the first fuel amount and the transient fuel limit.

20. The method of claim 15, further including establishing the predetermined time as a function of a first order lag function and a signal indicative of the amount of fuel delivered to the engine within a feedback loop wherein a presently determined amount of fuel delivered toward the engine is determined as a function of a previously determined amount of fuel delivered toward the engine.

* * * * *